US007666323B2

(12) United States Patent
Boguslavskiy et al.

(10) Patent No.: US 7,666,323 B2
(45) Date of Patent: Feb. 23, 2010

(54) SYSTEM AND METHOD FOR INCREASING THE EMISSIVITY OF A MATERIAL

(75) Inventors: Vadim Boguslavskiy, Princeton, NJ (US); Alexander Gurary, Bridgewater, NJ (US)

(73) Assignee: Veeco Instruments Inc., Plainview, NY (US)

( * ) Notice: Subject to any disclaimer, the term of this patent is extended or adjusted under 35 U.S.C. 154(b) by 108 days.

(21) Appl. No.: 10/920,589

(22) Filed: Aug. 18, 2004

(65) Prior Publication Data

US 2005/0274374 A1 Dec. 15, 2005

Related U.S. Application Data

(60) Provisional application No. 60/578,168, filed on Jun. 9, 2004.

(51) Int. Cl.
*C23F 1/00* (2006.01)

(52) U.S. Cl. ..... 216/52

(58) Field of Classification Search ..... 216/52
See application file for complete search history.

(56) References Cited

U.S. PATENT DOCUMENTS 3,704,179 A * 11/1972 Ty et al. ..... 148/270
5,152,870 A * 10/1992 Levinson ..... 216/44
5,246,530 A * 9/1993 Bugle et al. ..... 216/56
5,285,131 A * 2/1994 Muller et al. ..... 313/578
5,592,927 A * 1/1997 Zaluzec et al. ..... 123/668
5,843,289 A * 12/1998 Lee et al. ..... 204/192.3
7,040,130 B2 * 5/2006 Liu et al. ..... 72/53
2002/0086260 A1 * 7/2002 Shang et al. ..... 432/247

FOREIGN PATENT DOCUMENTS

TW 533248 5/2003
TW 554463 9/2003

* cited by examiner

*Primary Examiner*—Parviz Hassanzadeh
*Assistant Examiner*—Maureen Gramaglia
(74) *Attorney, Agent, or Firm*—Lerner, David, Littenberg, Krumholz & Mentlik, LLP

(57) ABSTRACT

A system and method is disclosed for increasing the emissivity of solid materials, wherein first the surface of the material is mechanically worked to create micro-level defects, and then etched to create a deep micro-rough surface morphology. In this manner, higher efficiencies and lower energy consumption can be obtained when these modified materials are used for heating elements. Heating elements made in accordance with this process thus operate at lower temperatures with longer lifetimes, when the improved heating elements are used with various heating devices.

14 Claims, 5 Drawing Sheets

SYSTEM AND METHOD FOR INCREASING THE EMISSIVITY OF A MATERIAL

CROSS-REFERENCE TO RELATED APPLICATIONS

This application claims the benefit of the filing date of U.S. Provisional Patent Application No. 60/578,168, filed Jun. 9, 2004, the disclosure of which is hereby incorporated herein by reference.

BACKGROUND OF THE INVENTION

The present application relates to modifying materials to increase their emissivity, and particularly relates to methods to increase the emissivity of metals for uses such as the absorption or emission of heat.

Materials with surfaces having high emissivity serve many useful functions, including the efficient absorption and emission of heat. In particular, electrical heating elements are used in numerous devices such as industrial reactors and ovens. Electrical energy applied to the heating element is converted into heat in the heating element and transferred from the heating element to another object, such as a part of the device or a workpiece being processed by the device.

In many devices, radiation is a significant mode of heat transfer. For example, in reactors used to process semiconductor wafers, a heating element is spaced apart from a carrier holding the wafers, and transfers heat to the carrier by radiant heat transfer.

In radiant heat transfer, the amount of heat transferred from a heating element increases with the temperature of the heating element and also varies directly with the emissivity of the heating element. The same is true for the amount of heat or radiation absorbed by the part being heated. As further discussed below, emissivity is a ratio between the amount of radiation emitted from a surface and the amount of radiation emitted by a theoretically perfect emitting surface referred to as a "black body," both being at the same temperature. The emissivity of a surface can be stated as a percentage of black body emissivity. A heating element having a higher emissivity radiates more energy at a given temperature. Unfortunately, many materials which have other desirable properties for use as heating elements also have relatively low emissivity.

Presently, the most widely used methods for increasing the surface emissivity are mechanical processing of the surface aimed to increase the surface area, and coating the surface with high-emissivity materials.

Mechanical surface treatments include various groove cutting, knurling, and different forms of blasting. These processes are sometimes difficult to control and may sometimes cause unacceptable results when used alone, especially for very thin parts such as certain resistive heater elements. Most importantly, they typically produce only modest increases in emissivity. For example, the emissivity of molybdenum sheet increases from 14-15% to 20-25% after sand blasting or shot peening.

Another methodology for increasing surface emissivity is coating the surface of a first material with second materials of high emissivity. This typically results in surface emissivity equal to that of the coating. This can produce the desired higher emissivity results at room temperature, but the reliability of the coating at high temperatures and in aggressive thermal, pressure or reactive environments is usually low. One reason for this is, for example, a difference in linear expansion between the base material and coating. After several thermal cycles, the coating may start to crack and peel off. Moreover, many coatings have low mechanical strength and are easily scraped or otherwise removed from the surface during installation and exploitation. Lastly, for the applications such as semiconductor, medical, food, pharmaceutical, etc. industries, there are issues of chemical compatibility with process environment and contamination of the process by the material of the coating.

Another possible way to increase surface emissivity is to apply a coating having the same composition as the base material, using a coating process such as a chemical vapor deposition (CVD) process tuned in such a way as to produce very irregular surface morphology. The main shortcoming of those coatings is very low mechanical strength and low adhesion to the surface of the base material.

Thus, despite all of the efforts in the art, there has been a need for further improved methods for increasing the emissivity of elements such as heating elements.

SUMMARY OF THE INVENTION

One aspect of the present invention provides a method to significantly increase the surface emissivity of a heating element or other material that involves modification of the surface on a microscopic level. Certain methods according to this aspect of the invention can be performed without requiring the introduction of any additional chemical elements into the material itself, and without requiring macroscopic reshaping. The most preferred methods according to this aspect of the present invention provide one or more surfaces of the material with high emissivity which remains high during prolonged service period. These methods obviate issues of chemical compatibility and contamination of the process by the modification.

A method according to this aspect of the invention includes initially mechanically working the surface of an material and then etching the mechanically worked surface. The mechanical working process can include a wide variety of mechanical processes, such as contacting the surface with a tool, or with a particulate medium, as, for example, by sand-blasting or shot peening the surface, or contacting the surface with one or more jets of a liquid. The etching step includes contacting the surface with an etchant which attacks the material of the element as, for example, by contacting the surface with a liquid such as nitric acid, or a plasma which reacts with or dissolves the material. Most preferably, the mechanical working acts to roughen the surface at the micro-level, whereas the etching step introduces further roughness.

Although the present invention is not limited by any theory of operation, it is believed that the mechanical working step causes local deformation at the surface and thus introduces microscopic defects into the material crystal structure at the surface, and that the etching step preferentially attacks the material at these defects. Regardless of the theory of operation, the preferred methods according to this aspect of the invention can provide materials with high, long-lasting emissivity.

In one aspect, the present invention is particularly useful in manufacture of heating devices with radiant heater elements. The present invention can also be applied to manufacture of other elements for other purposes. The present invention can be applied to, for example, susceptors for heating workpieces, absorptive surfaces for regulating thermal environments, and the like.

A further aspect of the invention provides a radiant element made by a process as discussed above. Still further aspects of the invention provide heaters including such elements, and systems which incorporate such heaters. The enhanced heating element emissivity provided according to preferred aspects of the present invention can provide benefits including higher heat transfer efficiency, lower energy consumption. In one aspect, the present invention advantageously lowers operating temperature of the heating element in a workpiece heating apparatus which is required to maintain a given workpiece temperature and thus allows for longer lifetime of the heating element.

DETAILED DESCRIPTION

Figure 1:
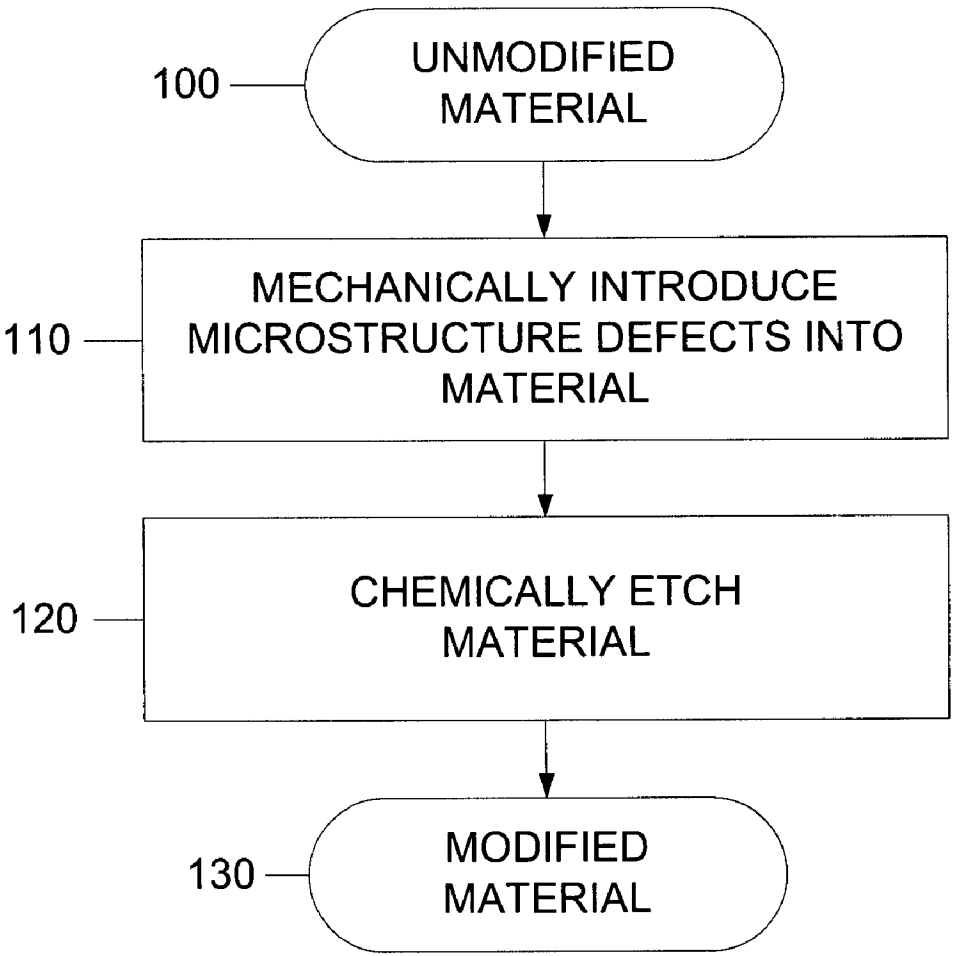
FIG. 1 shows a process flow chart for one embodiment of the present invention.

FIG. 1 shows a process flow chart for one embodiment of the present invention. A material (in this case, an unmodified heating element 100,) such as, for example, a molybdenum filament or a rhenium filament, is provided. Other materials and other heating elements can be formed of other electrically conductive materials as well. Preferably, the material is a refractory metal such as, for example, molybdenum, rhenium, niobium, tungsten, and the like, although the material may be an alloy and may also be a non-refractory metal or alloy such as, for example, stainless steel or aluminum. In the embodiment of FIG. 1, the emissivity of a heating element is improved via a two-step process: first, mechanical working 110 of the surface to create micro-level defects and, second, etching 120 of the surface. As a result, a modified material (in this case, a modified heating element 140) is created.

In mechanical working step 110, the surface of the heating element is cold worked and roughened by one or more processes such as sand blasting, shot peening, or mechanically working the surface with a tool to create micro-level defects. The cold working process locally deforms portions of the molybdenum or rhenium at the surface. It has also been found that water jetting effectively works the surface of the heating element.

The cold working process conditions are preferably adjusted in order to produce high level of micro-defects in the grains of crystal structure of the base material, and will vary by base material and roughening process used. Defects, such as dislocations and slip lines are highly desirable.

In etching step 120, the surface with the mechanically induced defects is etched, typically via a chemical etching process using a plasma or an acid such as nitric acid and the like. Generally, the same etch compounds used to reveal the crystal structure during the preparation of microscope specimens can be used successfully. The etching process attacks the defects much more aggressively than the base material. This results in deepening the surface imperfections, creating the network of grooves on the microscopic level. The concentration, temperature and duration of the etching process should be adjusted in such a way that produces highest emissivity without significant removal of the base material from the surface.

The mechanical working and etching steps can be performed while the element is in a final, usable form as, for example, in the form of a filament for use in an electrical resistance heater. Alternatively, the element can be subjected to further processing steps such as cutting or forming to a final desired shape after the working and etching steps, or between these steps.

In one example, the substrate is a machined, cleaned and etched molybdenum plate, with an initial integral spectral emissivity at 1.5 μm of about 10-12%.

To perform the mechanical roughening step, steel shot peening of the surface using shot of 300 micron diameter is performed until a uniform grey rough finish on the molybdenum plate is created. After this step, emissivity has been found to go up to about 35%.

Then, the etching step is performed by contacting the shot-peened surface with a 10% solution of nitric acid ($HNO_3$) in water for 30 minutes at room temperature (about 20° C.), after which the modified molybdenum or rhenium plate is rinsed and baked. The emissivity after etching for molybdenum has been found to be in the 50-55% range, and for rhenium has been found to be even higher, in the 70-80% range.

Figure 2:
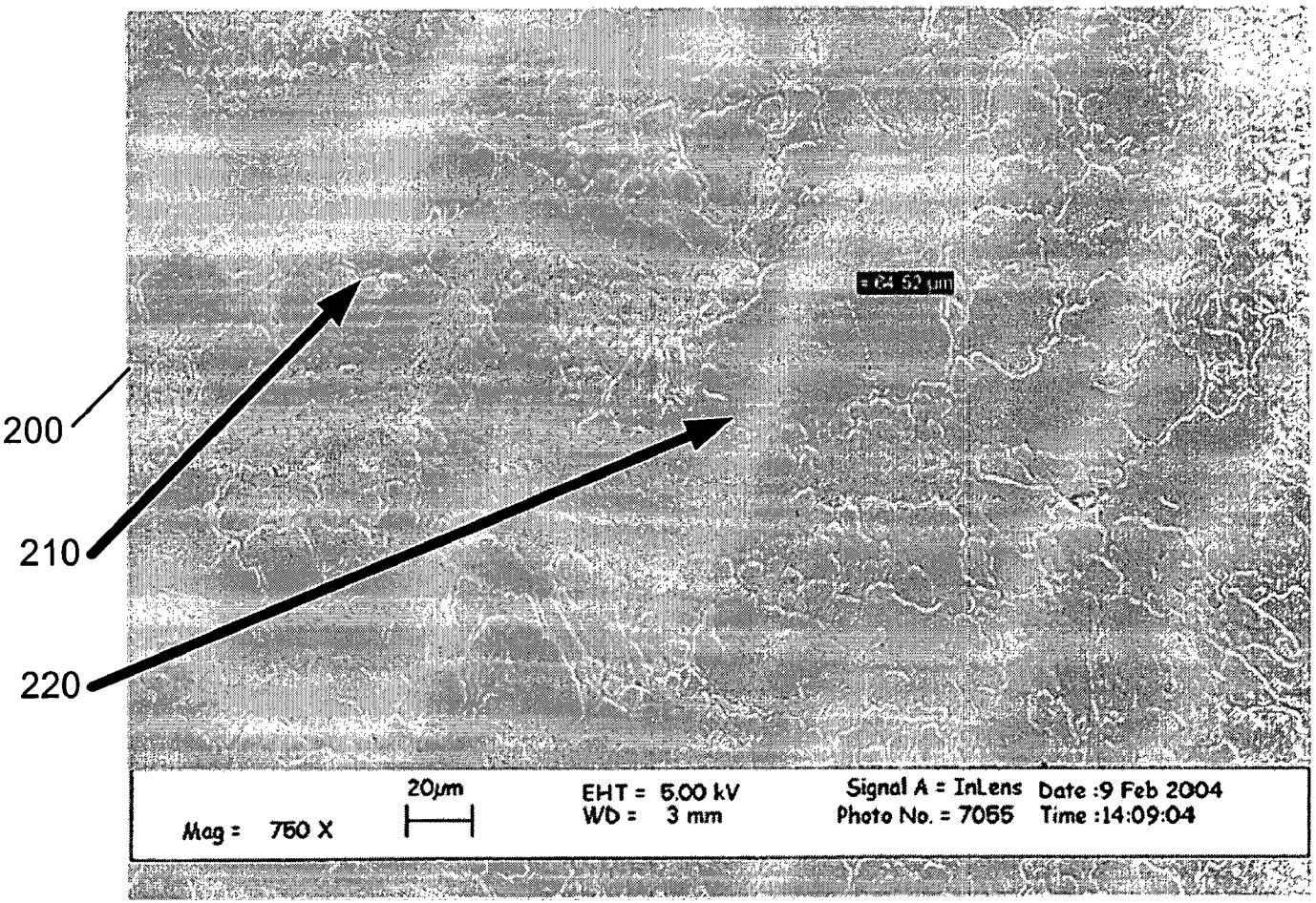
FIG. 2 shows an overhead image of a heating element surface at 750 times magnification before processing via one embodiment of the present invention.
Figure 3:
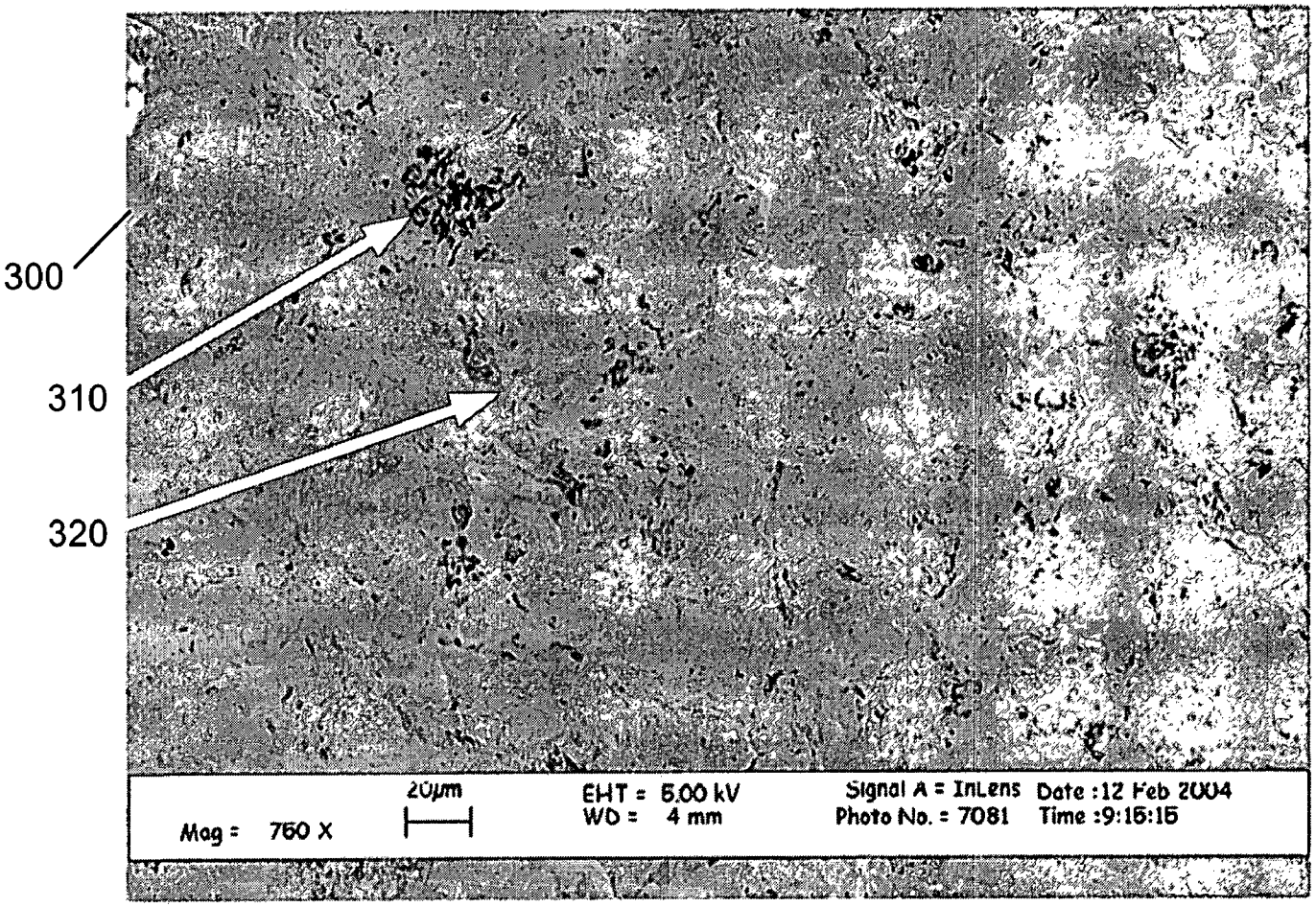
FIG. 3 shows an overhead image of a heating element surface at 750 times magnification after mechanical roughening via one embodiment of the present invention.
Figure 4:
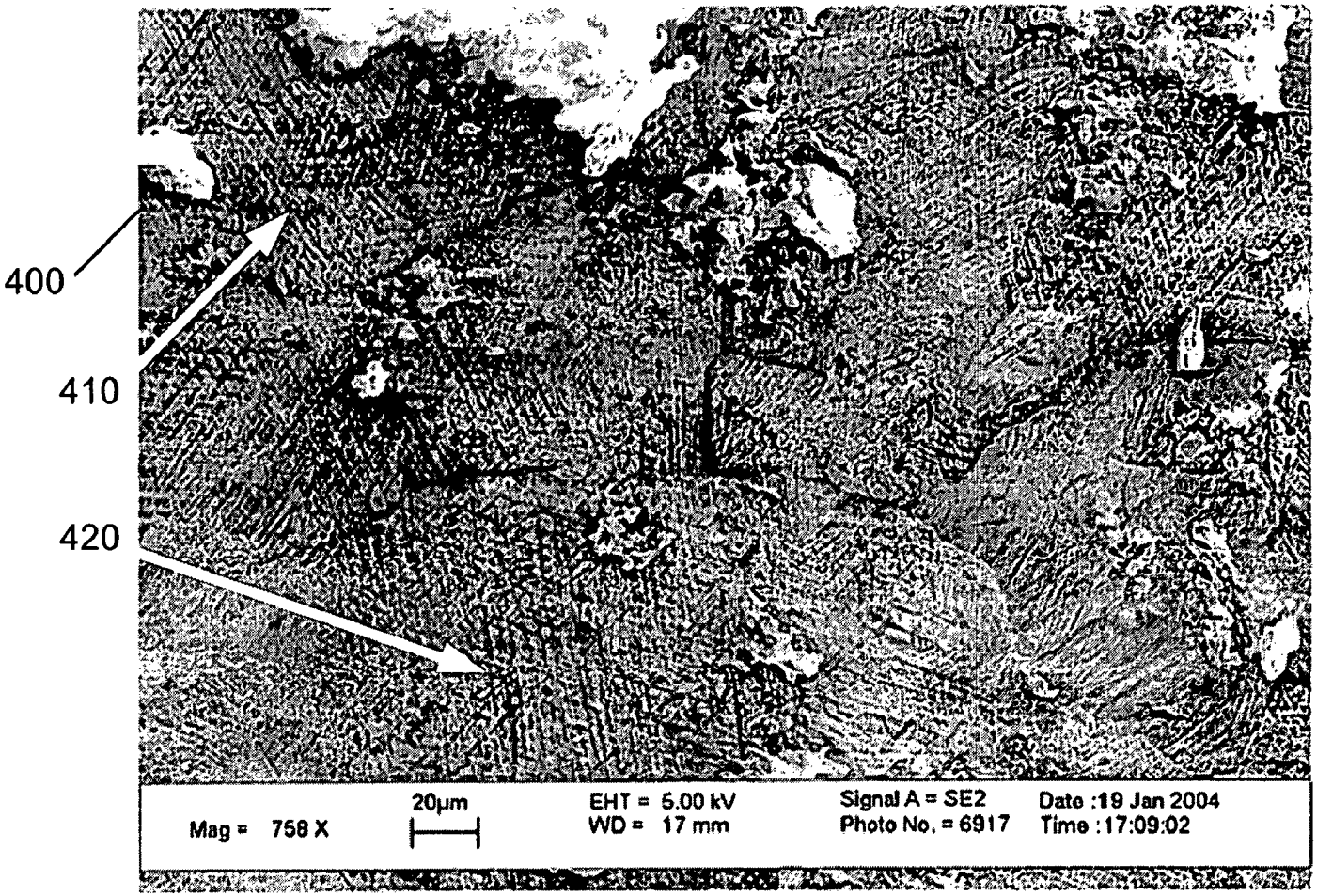
FIG. 4 shows an overhead image of a heating element surface at 750 times magnification after mechanical roughening and etching via one embodiment of the present invention.

FIGS. 2-4 provide some example microstructures at different stages of the example set forth above. FIG. 2 shows an overhead electron microscope image of the heating element surface 200 at 750 times magnification before processing. The image shows only minor surface features 210, 220 representative of crystal grain boundaries, typical of relatively low emissivity.

FIG. 3 shows an overhead image of a heating element surface 300 at 750 times magnification after the shot-peening step of the example. After roughening to create micro-defects in the surface of the material, minor surface features 310, 320 are visible due to shot peening and/or height variations on the surface of the material, in addition to crystal grain boundaries previously described.

FIG. 4 shows an overhead image of a heating element surface 400 at 750 times magnification after the shot peening and nitric acid etch. After both shot peening and etching, a "cross-hatch" pattern of surface defects (mostly slip-lines and some dislocations in the crystal structure of the material) 410, 420, are now visible over large region of the material, including within respective crystal grain boundaries. The surface, as a result, evidences increased emissivity relative to unaltered or mechanically roughened molybdenum.

Figure 5:
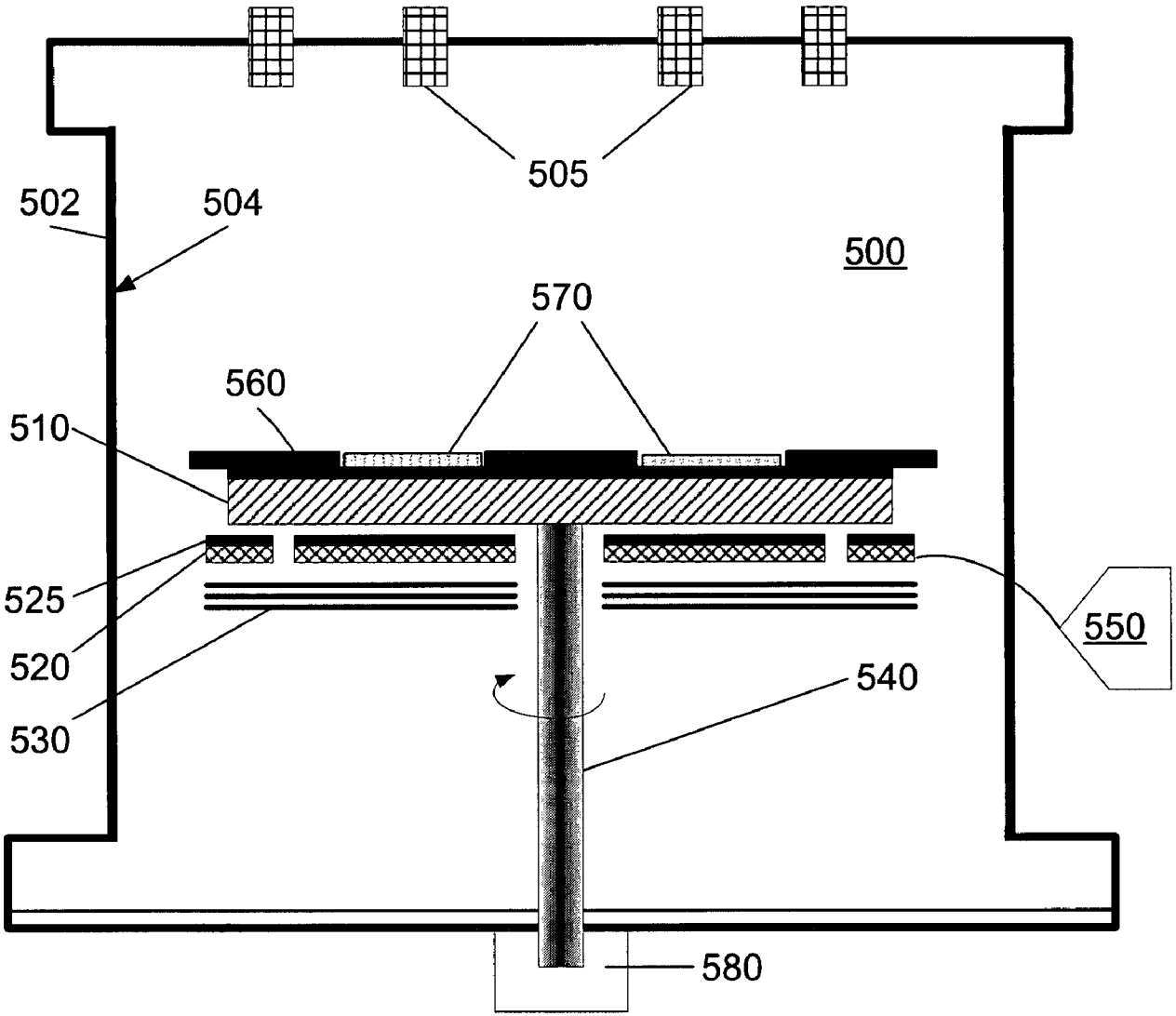
FIG. 5 is a diagrammatic cross-sectional view of a heating apparatus including the heating elements of one embodiment of the present invention.

FIG. 5 is a diagrammatic cross-sectional view of a semiconductor processing apparatus including one embodiment of the present invention, in this case a semiconductor reactor for wafer processing, drawn simplified and not to scale. The elements of the apparatus other than the heating elements may be a conventional susceptor-based rotating-disk reaction chamber for treatment of semiconductor wafers, or other semiconductor or CVD reactors, such those sold under the registered trademark TurboDisc® by the TurboDisc division of Veeco Instruments, Inc.

In one embodiment, the apparatus includes a reactor chamber 502 with an inner surface 504. At the top of the chamber, a set of gas inlets provide reactive gasses and/or carrier gasses, for example, to deposit epitaxial layers on a set of one or more wafers. A heating susceptor 510 is constantly heated by a set of heating elements 520, which may be divided into multiple heating zones. The heating elements 520 are preferably made of a refractory metal such as, for example, molybdenum or, more preferably, rhenium. The heating elements are provided with electrical current (not shown) linked to a source of electrical power (not shown). Moreover, the top surface of the heating elements 520 are treated by the above-described process to create a surface 525 with high emissivity.

A baffle 530 is disposed below the heating elements 520 and susceptor 510. The heating elements 520 and reactor 500 in general are controlled via an external controller 550. One or more wafers 570 are typically held in a wafer carrier 560 directly above the susceptor 510. In a rotating disk reactor, the wafer carrier 560 rotates on a shaft 540 driven by a motor 580 at speeds of up to, for example, 1500 RPM or higher. In operation, electrical power is converted to heat in heating elements 520 and transferred to susceptor 510, principally by radiant heat transfer. The susceptor in turn heats the wafer carrier 560 and wafers 570.

Advantageously, the process of the present application is not limited to heating elements, nor are applications limited to semiconductor reactors. The amount of radiation absorbed by an element exposed to radiant energy from an external source is also directly related to emissivity of the element. Thus, the present invention can be applied to elements which are intended to absorb radiant energy. For example, the surface of the susceptor 510 can be treated with the present process in order to increase its absorptivity, or surfaces of other components of the reactor may be similarly treated.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method of increasing the emissivity of a refractory metal material, comprising:

mechanically working at least one surface of the refractory metal material to locally deform the metal and create micro-level defects; and, etching the worked surface of the refractory metal material so as to preferentially remove metal at the defects and thereby increase its emissivity substantially without introduction of additional chemical elements into the refractory metal, the preferential removal of metal at the defects creating a microscopic network of grooves on the surface, wherein the network of grooves is exposed on the surface, wherein the emissivity of the refractory metal is increased by the network of grooves exposed on the surface, and wherein the refractory metal is a radiant heating element or a component of a semiconductor reactor.

2. The method of claim 1, wherein the mechanical working includes mechanically roughening the surface.

3. The method as claimed in claim 1 wherein said mechanical working includes engaging the surface by contacting the surface with a tool.

4. The method of claim 1, wherein the mechanical working includes contacting the surface with a particulate medium.

5. The method as claimed in claim 1, wherein the mechanical working includes shot peening the surface.

6. The method of claim 1, wherein the mechanical working includes contacting the surface with one or more jets of a liquid.

7. The method of claim 1, wherein the etching is performed by contacting the worked surface with a plasma.

8. The method of claim 1, wherein the refractory metal comprises rhenium.

9. The method of claim 1, wherein the refractory metal comprises molybdenum.

10. The method of claim 1, wherein the refractory metal comprises tungsten.

11. The method of claim 1, wherein the refractory metal comprises an alloy including niobium.

12. The method of claim 1, wherein the etching is performed by contacting the worked surface with a liquid.

13. The method of claim 12, wherein the liquid is an acid.

14. The method of claim 13, wherein the acid is nitric acid.

* * * * *

UNITED STATES PATENT AND TRADEMARK OFFICE

CERTIFICATE OF CORRECTION

PATENT NO. : 7,666,323 B2
APPLICATION NO. : 10/920589
DATED : February 23, 2010
INVENTOR(S) : Boguslavskiy et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 361 days.

Signed and Sealed this

Seventh Day of December, 2010

David J. Kappos

David J. Kappos
*Director of the United States Patent and Trademark Office*